United States Patent [19]

Tovi

[11] 4,112,486

[45] Sep. 5, 1978

[54] REMOTELY CONTROLLED POSITIONING DEVICE FOR ILLUMINATING UNIT AND THE LIKE

[75] Inventor: Murray Tovi, New York, N.Y.

[73] Assignee: Murray Tovi Designs, Inc., New York, N.Y.

[21] Appl. No.: 690,288

[22] Filed: May 26, 1976

[51] Int. Cl.[2] ..... F21M 3/18; F21S 3/02; F21S 1/02

[52] U.S. Cl. ..... 362/419; 248/183; 362/275

[58] Field of Search ..... 240/1 R, 1.4, 3, 3.1, 240/52 R, 61.05, 68, 69, 70; 248/183; 362/33, 269, 275, 368, 371, 372, 401, 418, 419, 422

[56] References Cited

U.S. PATENT DOCUMENTS

| | | | |
|---|---|---|---|
| 2,097,537 | 11/1937 | Snyder | 240/3 |
| 3,005,087 | 10/1961 | Klein | 240/1.4 |
| 3,188,460 | 6/1965 | Thorsen et al. | 240/52 R |
| 3,209,136 | 9/1965 | Fisher | 240/3 |
| 3,543,016 | 11/1970 | Jones | 240/3 |
| 3,967,107 | 6/1976 | Junginger | 240/1.4 |

*Primary Examiner*—Fred L. Braun
*Attorney, Agent, or Firm*—Fleit & Jacobson

[57] ABSTRACT

A mechanism for adjustably supporting a light unit for movement in any direction throughout a wide range, which mechanism is electrically powered and arranged for remote control. The mechanism includes a fixed driving unit having a reversible motor, the shaft of which is provided with a support member for supporting the light unit for rotation about the axis of the motor shaft. The light unit is also provided with a reversible motor, the shaft of which is utilized to support the light unit on the support member for rotation of the light unit about the axis of its motor shaft. The respective motor shafts are perpendicular to one another, and rotation of both the support member and light unit are limited by stop members to predetermined rotary paths thereby protecting flexible conductors which extend from the light unit motor and lamp to the driving unit. Switch elements control the energization of the motors, as well as the actuation of the light.

23 Claims, 7 Drawing Figures

FIG. 3
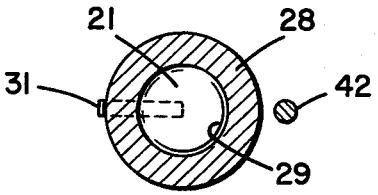
FIG. 4
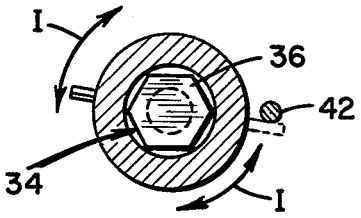
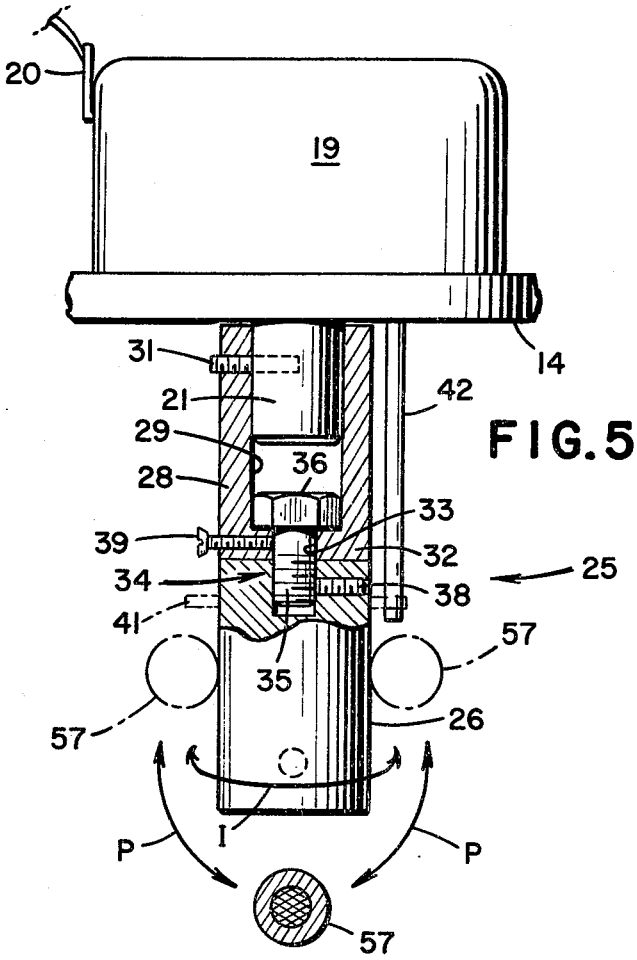
FIG. 5
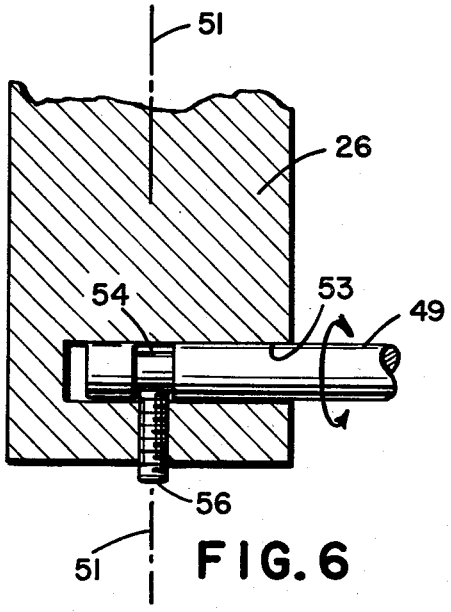
FIG. 6
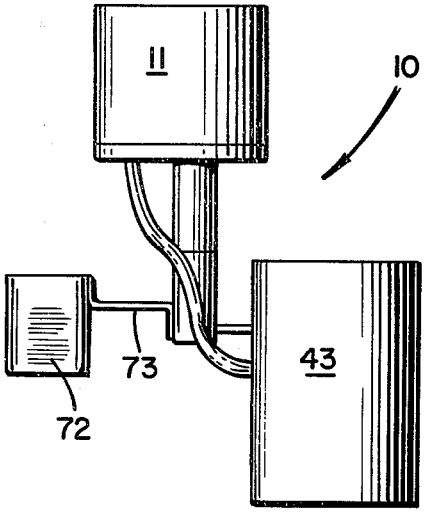
FIG. 7

REMOTELY CONTROLLED POSITIONING DEVICE FOR ILLUMINATING UNIT AND THE LIKE

BACKGROUND OF THE INVENTION

This invention relates to a transport mechanism for moving operative devices such as illuminating devices, and more specifically to a remotely controlled mechanism for adjustably positioning a light unit.

It is frequently desirable that a light unit or the like be adjustably positioned by remote control in any direction throughout a wide range so as to project, for example, a lamp beam from the light unit in the desired direction. Furthermore, it is highly desirable that such a light unit respond quickly after initiation of its movement and during its movement from one orientation to another.

Structures are in use today which employ electrically operated component parts with suitable switching arrangements by means of which a driving mechanism is actuated for moving a light unit into a selected position for focusing the lamp beam on the object to be illuminated. However, such presentday mechanisms generally require the use of bulky and complex mechanical and electrical components such as selsyn motors, servomechanisms, chain drives, and the like, and hence such present-day structures are heavy, slow to respond and prone to mechanical or electrical failure, as well as being extremely expensive. Furthermore, it has been the common practice to utilize commutators for maintaining electrical integrity between the moving parts and the source of electrical power during the adjusting operation. When many electrical connections need to be made across such commutator, complexity and reliability problems significantly increase.

SUMMARY OF THE INVENTION

A primary object of the present invention is to provide a novel mechanism for adjustably moving a device such as a light unit in any direction throughout a wide range to an adjusted position.

Another object of this invention is to provide a novel positioning device for a unit which is remotely controlled to permit the unit to be adjustably moved in any direction to an adjusted position throughout a range suitable for a wide variety of uses.

A further object of this invention is to provide a novel electrically operated, positioning device for a unit which avoids the use of commutators by protecting ordinary flexible electrical conductors.

This invention further contemplates the provision of a novel, remotely controlled positioning device for a unit which utilizes a minimum of component parts, which is of simple and inexpensive construction, which is adapted to control the position of units of a wide variety of types, and which is capable of prolonged use without breakdown.

A still further object of this invention is to provide a novel remotely controlled positioning device for a unit which may be moved to an adjusted position in a smooth and rapid manner in any direction, and which may be simply and easily mounted on any suitable support and in any selected position.

The foregoing specifically enumerated objects of the invention and other related objects are accomplished by the provision of a driving unit comprising a housing in the interior of which is mounted a motor having a shaft projecting outwardly from the housing. A support member is mounted on the outwardly projecting portion of the shaft by suitable mounting means including a friction coupling to enable relative axial rotation between the support member and the motor shaft. Also provided is a unit such as a television camera, light unit or the like, to be adjustable positioned and having a housing in the interior of which is located a second motor. The shaft of this second motor extends from the housing and is connected by suitable means, including a friction coupling, to the support member for supporting the movable unit. The respective axes of the motor shafts are disposed in a right angle relationship, and hence the unit is rotatable into virtually unlimited positions. Stop means are provided on the driving unit and on the movable unit for limiting the rotation of said units to less than a full 360°, in order to protect the flexible power and central cables which extend between the driving unit and the movable unit. Preferably, rotation about the driving unit motor shaft is limited on the order of 220°. Switch means are also provided for connecting the respective motors and operational mechanisms in the movable unit to an associated source of electrical power.

While the following passages are specifically directed to a remotely controlled illuminating device, it should be appreciated that the present invention serves equally well as a transport mechanism for many other movable devices.

The foregoing and other objects of the present invention, as well as many of the attendant advantages thereof, will become more readily apparent when reference is made to the following description, taken in conjunction with the accompanying drawings.

BRIEF DESCRIPTION OF THE DRAWINGS

FIG. 3 is a sectional view taken in the direction of the arrows substantially along site line 3—3 of FIG. 2;

FIG. 4 is a sectional view taken in the direction of the arrows substantially along site line 4—4 of FIG. 2;

FIG. 5 is an enlarged sectional view of a portion of the device of FIG. 2;

FIG. 6 is an enlarged sectional view of another portion of the device illustrated in FIG. 2; and FIG. 7 is a partial view of another embodiment of the inventive illuminating device.

DETAILED DESCRIPTION OF THE DRAWINGS

Figure 1:
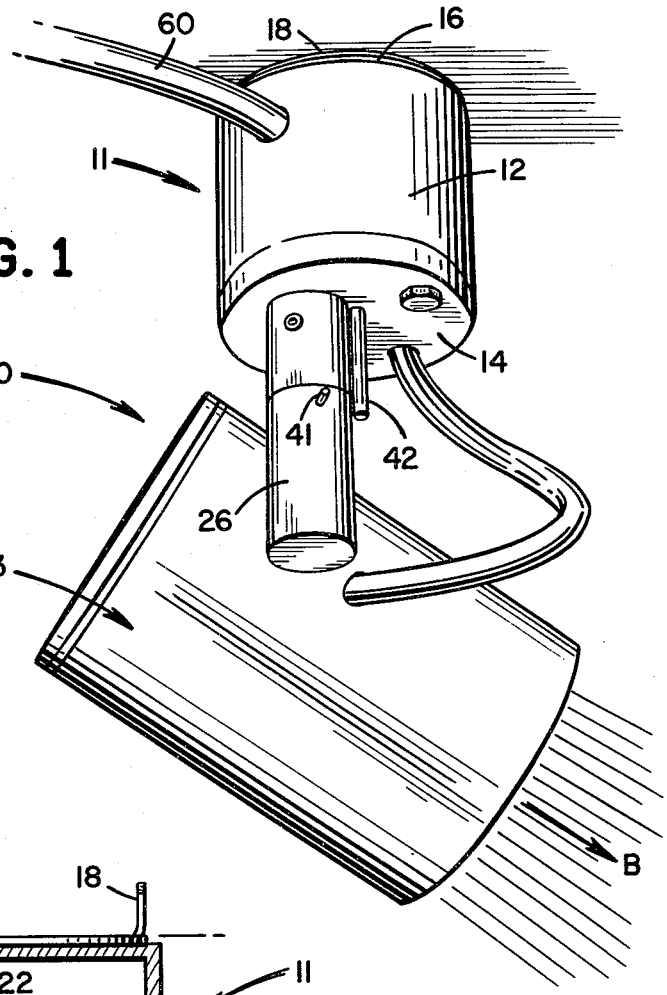
FIG. 1 is a perspective view of an embodiment of an illuminating device constructed in accordance with the teachings of the present invention.

Referring now to the drawings and to FIGS. 1 and 2 in particular, the illuminating device of the present invention will be described. The illuminating device is shown generally at 10 and includes a driving unit designated generally by the numeral 11 and having end walls 14 and 16 defining an interior 17. The housing 12 is arranged to be fixedly mounted on any supporting surface such as a ceiling, wall or the like by suitable means such as a bracket 18.

Figure 2:
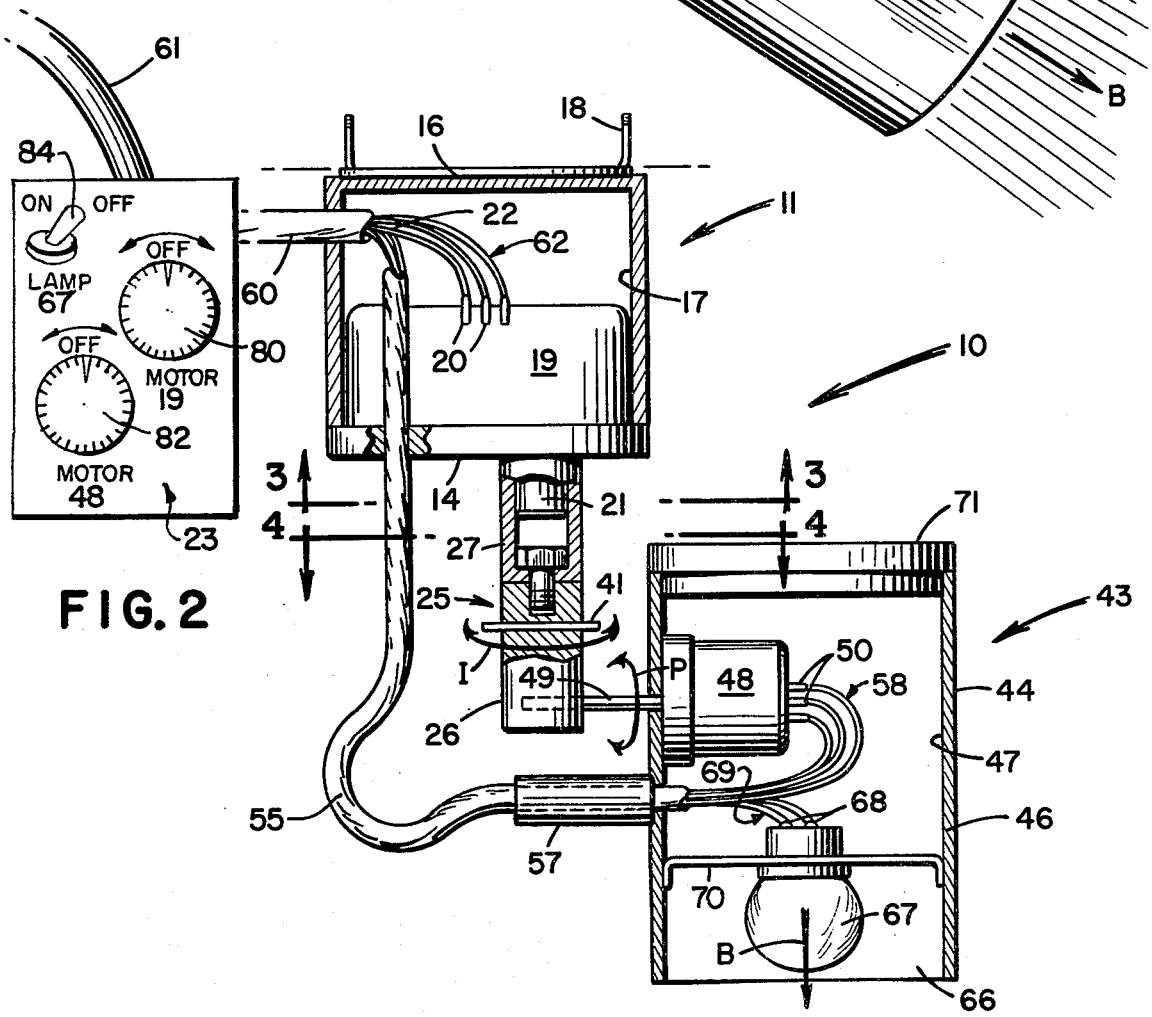
FIG. 2 is a side elevation, partially in section, of the device shown in FIG. 1.

A motor 19 having a shaft 21 is suitably mounted within the housing interior 17 with the shaft 21 projecting outwardly from the housing front wall 14 as shown best in FIGS. 2 and 5. The motor 19 is reversible, is preferably of the gear motor slow speed type, and is provided with terminals 20 to which are connected conductors 60 for connecting the motor 19 to an associated source of electrical power (not shown). The motor 19 is connected by conductors 60 to the associated source of electrical power through suitable switch means 23 of conventional construction by means of which the illuminating device of the invention is controlled.

A support member 25 is mounted by suitable means including a friction coupling to the motor shaft 21 for rotation therewith. More specifically, as shown best in FIG. 5, the support member 25 preferably comprises a rod member 26 and a sleeve member 27 having a side wall 28 defining a bore 29. The sleeve member 27 is mounted on the outwardly projecting end portion of motor shaft 21 in coaxial relationship therewith and is fixedly secured thereto by means of a set screw 31 or the like, extending through the sleeve member side wall 28 with its inner end in engagement with the end portion of shaft 21.

The opposite extremity of the sleeve member 28 has a portion of reduced diameter forming a flange 32 which defines an opening 33. A bolt 23 having a threaded shank 35 and a head 36 is suitably connected to one end of the rod member 26 by engagement with an internally threaded recess 37. The head 36 of the bolt 34 sits in abutting engagement in the inner surface of the flange 32 while the shank 35 extends through the opening 33. Bolt 34 is retained fixed in the rod member recess 37 by means of a set screw 38, and a radial pin 39 of nylon, teflon or the like extends through the sleeve member 27 to frictionally engage the shank 35 of bolt 34.

The rod member 26 is thus connected to the motor shaft 21 for rotation therewith in either direction as indicated by the double arrows "I", a friction clutch arrangement being provided by means of the engagement between the radial pin 39 and bolt 34. With such a frictional clutch arrangement, relative rotation is permitted between the sleeve member 27 and the rod member 26 when the frictional gripping force exerted on the bolt 34 by the pin 39 is overcome.

Stop means are provided on the driving unit 11 for limiting the rotation of the rod member 26 to a predetermined rotary path. More specifically, a radial pin 41 is shown to be mounted on the outer surface of the rod member 26 adjacent the sleeve member 27 for engagement with rod 42 mounted on the front wall 14 of unit 11 and extending parallel to the axis of shaft 21. Thus, during the rotation of the rod member 26 by its engagement with motor shaft 21, the pin 41 engages the rod 42 at the ends of a predetermined rotary path, thereby preventing further rotation of the rod member 26 while permitting slipping action between the sleeve member 27 and the rod 26. Preferably means are provided, such as two opposed pins 41, to limit rotation about shaft 21 to on the order of 220°.

The illuminating device of the invention includes a movable light unit shown generally by the reference numeral 43. The light unit 43 includes a housing 44 having a side wall 46 defining an interior 47 in which a motor 48 having a shaft 49 is fixedly mounted. The motor 48, which is also preferably of the reversible gearmotor type, is provided with terminals 50 by means of which the motor 48 is connected to the associated source of electrical power.

The shaft 49 has an end portion projecting outwardly from the housing side wall 46 as shown best in FIG. 2, and means are provided for connecting the outer end portion of shaft 49 to the support member or rod member 26. In this manner, the light unit 43 is supported for rotation about the axis of the driving unit motor shaft 21 throughout the rotary path indicated by the double arrow "I". The light unit 43 may also be rotated about the axis of the motor shaft 49, as indicated by double arrow "P". As can be seen, the motor shafts 21 and 49 are disposed in a right angle relationship, defining an "L" connection with intermediate support member 26, and therefore, the housing has substantially full freedom of rotation about two axes.

The light unit 43 is provided with an open end 66 and a lamp or bulb 67 of the incandescent type or the like having terminals 68 is mounted in the housing interior 47 by suitable means such as a mounting bracket 70. The lamp 67 is thus arranged, when energized, to project an illuminating beam out of the housing open end 66 in the direction of the arrow "B".

Referring now to FIG. 6, the means for connecting the end portion of the shaft 49 to the rod member 26 can be seen to comprise a recess 53 in the outer end of the rod member 26 which rotatably accommodates the end portion of the shaft 49 in coaxial relationship therewith. Such connecting means also includes a friction clutch arrangement for frictionally retaining the shaft 49 against rotation in the recess 53, until a predetermined rotational force is overcome. More specifically, the friction clutch arrangement comprises a peripheral groove 54 in the shaft 49 and a set screw 56 frictionally engaging the shaft 49 within the groove 54 to frictionally retain the shaft 49 against the rotation in the recess 53.

Stop means are provided on the light unit 43 for limiting the rotation of the light unit 43 about the axis of motor shaft 49 to a predetermined rotary path. In the illustrated embodiment, the stop means includes a post 57 extending outwardly from the housing side wall 46 in parallel relationship with the shaft 49. Thus, during rotation of the light unit 43 in the direction of the double arrow "P", the post 57 engages the rod member 26 at opposite ends of the rotary path of the light unit. The frictional gripping engagement between the set screw 26 and the shaft groove 54 is then overcome so that even though the motor 48 remains energized, further rotation of the unit 43 is prevented with slippage taking place between the set screw 56 and shaft 49 until the motor 48 is deenergized.

Control means including appropriate switching is provided for connecting both of the motors 19 and 48 and the lamp 67 to the associated source of electrical power, the connecting means for motor 19 having been previously described. The connecting means for motor 48 includes a flexible cable 55 including a plurality of conductors preferably enclosed in a plastic sheath. The conductors of cable 55 are connected at one end to the terminals 50 of the motor 48 within the interior 47 of the second unit housing 44, and to the terminals 68 of lamp 67. The other end of the conductors extend out of the housing 44 and into the housing interior 17.

The post 57 on housing 44 is preferably provided with a central bore through which the flexible conductors 58 and conductors 69 of cable 55 pass into the housing interior 47. The conductors 58 and 69 within the sheath extend loosely between units 11 and 43 into the housing of unit 11 to be joined with conductors 62 in a common conductor package 60 passing out of the first unit housing 12 to the remotely located switch means 23. The switch means 23 may be connected by means of conductors 61 to the associated source of electric power.

It should be understood that the switch means 23 are of conventional construction, permitting selective and directional actuation of either one or both of the motors 19 and 48, as well as controlling the lamp 67. For example, as shown in FIG. 2, motors 19 and 48 can be controlled by two-direction switches 80 and 82, respectively, and lamp 67 can be controlled by an on-off switch 84.

In order to minimize the load imposed on the component parts of the positioning device of the invention by the light unit 43, and to ensure a rapid response of the unit 43 during the positioning operation, suitable counterbalancing means are preferably provided on the light housing 44. More specifically, as shown best in FIG. 2, such counterbalancing means may include a counterweight 71 secured at one end to the housing 44 of unit 43 so that the weight of unit 43 is balanced about shaft 49. Similarly, counterbalancing means may be provided on the driving unit 11 and, as shown best in FIG. 7, such counterbalancing means may be in the form of a counter-weight 72 secured by means of a bracket 73 to the rod member 26 on the opposite side of the rod member 26 from the light unit 43. Thus, the load on the motor 19 and the associated parts is also minimized.

In the operation of the invention, for changing the position of the light unit 43, the switch 23 is manipulated in the conventional manner to energize motor 19 or motor 48, or both. Energization of motor 19 moves the unit 43 in its rotary path as indicated by the double arrow "I" about the axis 51. Energization of motor 48, in turn, moves the unit 43 as indicated by the double arrow "P". In this manner, the unit 43 may be moved in any direction to a virtually unlimited number of selected positions.

In the event that motor 19 is operated to one of the ends of the rotary path indicated by the double arrow "I", engagement occurs between a pin 41 and post 42 so that further rotation of rod member 26 is terminated and slippage occurs between the pin 39 and bolt 34. Similarly, in the event the motor 48 is operated so that the unit 43 reaches one of the ends of the rotary path as indicated by the double arrow "P", engagement occurs between the post 57 and rod member 26 terminating further movement of the unit 43 with slippage occurring between the set screw 56 and motor shaft 49.

During the positioning operation of the inventive lighting fixture, the lamp 67 may be energized or not. The lamp may be turned on or off in any position of the light unit 43 by means of the switch 23.

It should be noted that with the inventive illuminating device as described above, light may be directed in virtually any direction, and yet without risking damage to the wires between the lamp and the fixed mounting unit. In particular, the rotation of the unit 43 about the axis of shaft 21 can be limited to on the order of 220°. Bulb 67 is still able to beam in all directions, because the unit 43 is able to traverse nearly a full 360° about the axis of shaft 49. Wires 58 may therefore be continuous, which is important as the number of conductors increases (such as if a plurality of independently operated bulbs were provided).

While I have described flexible electrical wires between the housing 12 and unit 43, it should be noted that in addition other flexible members such as hollow tubes and the like could be protected against breakage or crimping by my invention.

Above, specific embodiments of the present invention have been described. It should be appreciated, however, that these embodiments were described for purposes of illustration only, without any intention of limiting the scope of the present invention. Rather, it is the intention that the present invention be limited not by the above but only as is defined in the appended claims.

What is claimed is:

1. A remotely controlled electrically operated positioning device comprising: a first motor having a housing and having a shaft rotatable relative to and extending from said housing; means for rigidly fixing the housing of said first motor on a support; a functional device designed to be positioned by said positioning device; a second motor having a housing and having a shaft rotatable relative to and extending from said housing; means for rigidly fixing the housing of said second motor relative to said functional device; coupling means for connecting the ends of the respective shafts of said first and second motors extending from their respective housings in a right angle relationship so that said first shaft, said coupling means and said second shaft define an "L" connection; means for actuating said first motor; and means for actuating said second motor.

2. A positioning device capable of orienting a directional functional unit in any desired position, the device comprising, in combination: a fixed base unit including a first rotatable shaft extending therefrom; a functional unit including a second rotatable shaft extending therefrom; mounting means for mounting said functional unit on said base unit, said mounting means coupling the end of said first shaft extending from said base unit directly to the end of said second shaft extending from said functional unit in a substantially right angle relationship so that said first shaft, said mounting means and said second shaft define an "L" connection; means for actuating said functional unit for operating the same; means for rotating said functional unit about the axis of said first shaft; means for rotating said functional unit about the axis of said second shaft; first stop means for limiting the rotation of said functional unit about said first shaft to less than 360°; second stop means for limiting the rotation of said functional unit about said second shaft to less than 360°; and flexible cable means extending from said fixed base unit to said functional unit.

3. A positioning device in accordance with claim 2, wherein said first stop means limits rotation to on the order of 220°.

4. A positioning device in accordance with claim 2, wherein said mounting means includes a support member intermediate said first shaft and said second shaft.

5. A positioning device in accordance with claim 4, and further comprising first friction coupling means for frictionally connecting said support member to said first shaft; and second friction coupling means for frictionally connecting said second shaft to said support member.

6. A positioning device in accordance with claim 2, and further comprising counterbalancing means mounted on said functional unit so that said functional unit is in balance about said second shaft.

7. A positioning device in accordance with claim 2, and further comprising counterbalancing means mounted on said mounting means so that said functional unit is in balance about said first shaft.

8. The positioning device recited in claim 2, and further comprising a first motor, the shaft of which is said first rotatable shaft; and a second motor, the shaft of which is said second rotatable shaft.

9. A remotely controlled positioning device comprising, in combination: a fixed driving unit including a first motor having a first rotatable shaft extending therefrom; a functional unit including a second motor having a second rotatable shaft extending therefrom; mounting means for mounting said functional unit on said driving unit, said mounting means coupling the end of said first shaft extending from said fixed driving unit directly to the end of said second shaft extending from said functional unit in a substantially right angle relationship so that said first shaft, said mounting means and said second shaft define an "L" connection; means for actuating said functional unit; means for actuating said first motor for rotating said functional unit about the axis of said first shaft; means for actuating said second motor for rotating said functional unit about the axis of said second shaft; first stop means for limiting the rotation of said functional unit about said first shaft to less than 360°; and second stop means for limiting the rotation of said functional unit about said second shaft to less than 360°; wherein said means for actuating said second motor and said functional unit includes flexible continuous electrically conductive cables extending from said fixed driving unit to said functional unit.

10. The positioning device recited in claim 9, wherein said first stop means limits rotation to on the order of 220°.

11. A remotely controlled illuminating device comprising, in combination: a fixed driving unit including a first motor having a first rotatable shaft extending therefrom; a light unit including a second motor having a second rotatable shaft extending therefrom; mounting means for mounting said light unit on said driving unit, said mounting means coupling the end of said first shaft extending from said fixed driving unit directly to the end of said second shaft extending from said light unit in a substantially right angle relationship so that said first shaft, said mounting means and said second shaft define an "L" connection; illuminating means mounted in said light unit; means for actuating said illuminating means for directing a beam of light out of said light unit; means for actuating said first motor for rotating said light unit about the axis of said first shaft; means for actuating said second motor for rotating said light unit about the axis of said second shaft; first stop means for limiting the rotation of said light unit about said first shaft to less than 360°; and second stop means for limiting the rotation of said light unit about said second shaft to less than 360°; wherein said means for actuating said second motor and said illuminating means includes flexible continuous electrically conductive cables extending from said fixed driving unit to said light unit.

12. A remotely controlled illuminating device in accordance with claim 11, wherein said first stop means limits rotation to on the order of 220°.

13. A remotely controlled illuminating device in accordance with claim 11, wherein said mounting means includes a support member intermediate said first shaft and said second shaft.

14. A remotely controlled illuminating device in accordance with claim 13, and further comprising first friction coupling means for frictionally connecting said support member to said first shaft; and second friction coupling means for frictionally connecting said second shaft to said support member.

15. A remotely controlled illuminating device in accordance with claim 11, and further comprising counterbalancing means mounted on said light unit so that said light unit is in balance about said second shaft.

16. A remotely controlled illuminating device in accordance with claim 11, and further comprising counterbalancing means mounted on said mounting means so that said light unit is in balance about said first shaft.

17. A remotely controlled illuminating device in accordance with claim 11, wherein said driving unit includes a housing defining an interior; wherein said first motor is disposed within said housing interior with an end portion of said first shaft projecting outwardly from said housing interior; and wherein a support member is connected to the outwardly projecting end portion.

18. A remotely controlled illuminating device in accordance with claim 5, wherein said support member includes a rod member connected at one end to said first shaft in coaxial relationship therewith, and connected at the opposite end to said second shaft.

19. A remotely controlled illuminating device in accordance with claim 17, wherein said light unit includes a housing having a side wall defining an interior and an open end, said illuminating means is disposed within said housing interior for projecting a light beam through said housing open end, said second motor is disposed within said housing interior with an end portion of said second shaft projecting outwardly from said housing side wall, and said outwardly projecting second shaft end portion is connected to said support member.

20. A remotely controlled illuminating device in accordance with claim 19, wherein said support member comprises a rod member mounted at one end to said first shaft in coaxial relationship therewith; wherein the opposite end of said rod member includes a diametrally extending recess for accommodating said second shaft end portion; wherein said second shaft end portion is provided with a peripheral groove; and further including a set screw extending into the recess of said rod member in frictional engagement with the peripheral groove of said second shaft.

21. A remotely controlled illuminating device in accordance with claim 19, wherein said second stop means includes a post projecting outwardly from said light unit side wall in parallel, spaced apart relationship with said second shaft for engagement with said rod member.

22. A remotely controlled illuminating device comprising, in combination: a fixed driving unit including a first motor having a first rotatable shaft; a light unit including a second motor having a second rotatable shaft; mounting means for mounting said light unit on said driving unit, said mounting means coupling said first shaft to said second shaft in a substantially right angle relationship; illuminating means mounted in said light unit; means for actuating said illuminating means for directing a beam of light out of said light unit; means for actuating said first motor for rotating said light unit about the axis of said first shaft; means for actuating said second motor for rotating said light unit about the axis of said second shaft; first stop means for limiting the rotation of said light unit about said first shaft to less than 360°; and second stop means for limiting the rotation of said light unit about said second shaft to less than 360°; wherein said means for actuating said second motor and said illuminating means includes flexible continuous electrically conductive cables extending from said light unit; wherein said driving unit includes a housing defining an interior; wherein said first motor is disposed within said housing interior with an end portion of said first shaft projecting outwardly from said housing interior; wherein a support member is connected to the outwardly projecting end portion; wherein said support member includes a rod member connected at one end to said first shaft in coaxial relationship therewith, and connected at the opposite end to said second shaft; wherein said support member further includes a sleeve member having a side wall defining a bore adapted to associate with said first shaft, and having a flange portion of reduced diameter adapted to associate with said rod member; and further comprising means for fixedly securing said sleeve member to said first shaft in concentric relationship therewith; a coupling member disposed in said sleeve member having a head in abutting engagement with said flange portion and a shank extending through said flange portion; and means for frictionally securing the shank of said coupling member to said rod member.

23. A remotely controlled illuminating device in accordance with claim 22, wherein said first stop means comprises at least one pin projecting outwardly from said driving unit in parallel relationship with said first shaft, and a pin extending radially outwardly from said rod member.

* * * * *